US006364645B1

(12) United States Patent
Dieterich

(10) Patent No.: US 6,364,645 B1
(45) Date of Patent: Apr. 2, 2002

(54) SCREW COMPRESSOR HAVING A COMPRESSOR SCREW HOUSING AND A SPACED OUTER HOUSING

(75) Inventor: Rolf Dieterich, Horb (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/586,846

(22) Filed: Jun. 5, 2000

Related U.S. Application Data

(63) Continuation of application No. PCT/EP99/07445, filed on Oct. 6, 1999.

(30) Foreign Application Priority Data

Oct. 6, 1998 (DE) ..... 198 45 993

(51) Int. Cl.[7] ..... F04C 18/16; F04C 29/02; F04C 29/04

(52) U.S. Cl. ..... 418/86; 418/97; 418/201.1; 418/201.2; 418/DIG. 1

(58) Field of Search ..... 418/96, 97, 100, 418/201.1, 201.2, DIG. 1, 86

(56) References Cited

U.S. PATENT DOCUMENTS

| | | | | |
|---|---|---|---|---|
| 3,462,072 A | * | 8/1969 | Schibbye | 418/201.1 |
| 3,922,114 A | | 11/1975 | Hamilton et al. | 418/97 |
| 4,420,293 A | * | 12/1983 | Hofmann | 418/96 |
| 4,563,138 A | | 1/1986 | Hofmann et al. | 418/97 |
| 4,913,634 A | * | 4/1990 | Nagata et al. | 418/201.2 |
| 6,045,344 A | * | 4/2000 | Tsuboi et al. | 418/201.1 |

FOREIGN PATENT DOCUMENTS

| | | | |
|---|---|---|---|
| DE | 29 38 557 | 4/1981 | |
| DE | 81 36 225.0 | 2/1983 | |
| DE | 32 21 849 | 12/1983 | |
| GB | 2 122 687 | 1/1984 | |
| JP | 56-159594 | * 12/1981 | 418/201.1 |
| JP | 58-110890 | * 7/1983 | 418/DIG. 1 |
| JP | 3-15693 | * 1/1991 | 418/DIG. 1 |

OTHER PUBLICATIONS

*Patent Abstracts of Japan*, vol. 009, No. 087 (M–372), Apr. 17, 1985, Japanese Publication No. 59 215 986 published Dec. 5, 1984.

*Patent Abstracts of Japan*, vol. 009, No. 179 (M–399), Jul. 24, 1985, Japanese Publication No. 60 047 893 published Mar. 15, 1985.

*Patent Abstracts of Japan*, vol. 011, No. 295 (M–626), Sep. 24, 1987, Japanese Publication No. 62 087 685 published Apr. 22, 1987.

*Patent Abstracts of Japan*, vol. 1999, No. 08, Jun. 30, 1999, Japanese Publication No. 11 062 869 published Mar. 5, 1999.

*Patent Abstracts of Japan*, vol. 003, No. 140, Nov. 20, 1979, Japanese Publication No. 54 115 409 published Sep. 8, 1979.

*Patent Abstracts of Japan*, "Sealed Typed Screw Compressor", Nov. 20, 1979, vol. 3/No. 140.

*Patent Abstracts of Japan*, Abstract of Japanese Patent "Oil Separator of Screw Compressor", Publication No. 10159763, Jun. 16, 1998, Japanese Application No. 08319376, Filed Nov. 29, 1996.

* cited by examiner

*Primary Examiner*—John J. Vrablik
(74) *Attorney, Agent, or Firm*—Barry R. Lipsitz; Douglas M. McAllister

(57) ABSTRACT

In order to improve a screw compressor for compressing a working medium, comprising an outer housing, two screw rotors which are arranged in the outer housing in rotor bores provided for them and a drive for the screw rotors, in such a manner that the sealing gap is subject to as little variation as possible it is suggested that a compressor screw housing, in which the rotor bores for the screw rotors are arranged, be provided within the outer housing and that a space be arranged between a substantial part of the compressor screw housing and the outer housing.

30 Claims, 6 Drawing Sheets

SCREW COMPRESSOR HAVING A COMPRESSOR SCREW HOUSING AND A SPACED OUTER HOUSING

The present disclosure relates to the subject matter disclosed in International Application No. PCT/EP99/07445 of Oct. 6, 1999, the entire specification of which is incorporated herein by reference.

The invention relates to a screw compressor for compressing a working medium, comprising an outer housing, two screw rotors which are arranged in the outer housing in rotor bores provided for them and a drive for the screw rotors.

In the case of screw compressors of this type, the sealing gap formed between the screw rotors and the rotor bores is a critical parameter since this is responsible for the leakage. The sealing gap normally varies on account of thermal or other influences.

The object underlying the invention is therefore to improve a screw compressor of the generic type in such a manner that the sealing gap is subject to as little variation as possible.

This object is accomplished in accordance with the invention, in a screw compressor of the type described at the outset, in that a compressor screw housing, in which the rotor bores for the screw rotors are arranged, is provided within the outer housing and that a space is arranged between a substantial part of the compressor screw housing and the outer housing.

The provision of a space serves in this respect to couple the compressor screw housing and the outer housing as little as possible thermally and with a view to vibrations or even decouple them. The effects on the compressor screw housing of external, thermal influences acting on the outer housing of the screw compressor are thus reduced and the compressor screw housing itself has the possibility of taking up a thermal state of equilibrium and of remaining in this state, at least only with long-term variations. Moreover, vibrations of the compressor screw housing are transferred to the outer housing to a lesser extent.

With respect to the design of the compressor screw housing, no further details have been given in conjunction with the preceding embodiments. One advantageous embodiment, for example, provides for the compressor screw housing to have an inlet section, a compression section and an outlet section.

With respect to the extension of the space in azimuthal direction to the rotor bores, it is particularly advantageous when the space extends over at least half the circumference of the compression section in azimuthal direction.

It is particularly favorable when the space extends over at least approximately three quarters of the circumference of the compression section in order to thus disconnect as large a portion of the compression section as possible from the outer housing thermally and with regard to vibrations.

With respect to the extension of the space in the area of the inlet section of the compressor screw housing, no further details have so far been given. It is, for example, particularly favorable when the space extends in azimuthal direction to the rotor bores over at least half the inlet section. It is even better when the space extends over three quarters of the circumference of the inlet section in azimuthal direction.

Furthermore, no further details have been given in conjunction with the preceding explanations concerning individual embodiments with respect to the extension of the space in the area of the outlet section. Since the outlet section is in any case, on account of the exiting working medium, at the temperature thereof, it is in principle not absolutely necessary for the space to extend in the area of the outlet section, as well.

However, it is likewise advantageous when the space also extends in circumferential direction over the outlet section in order to bring about an even more uniform temperature in this section.

It is likewise particularly advantageous when the space extends over at least half the circumference of the outlet section in azimuthal direction, even better over approximately three quarters of the circumference of the outlet section in azimuthal direction.

With respect to the extension of the space in axial direction of the screw rotors, no further details have likewise been given in conjunction with the preceding explanations concerning the individual embodiments. One advantageous embodiment, for example, provides for the space to extend on average over at least half of a length of the compressor screw housing extending in axial direction of the screw rotors.

In this respect, it is expedient when the space extends from an end of the compressor screw housing on the outlet side in the direction of an end thereof on the inlet side.

In this respect, it is especially favorable when the space extends at least over the compression section in axial direction.

It is particularly favorable when the space extends as far as the inlet section and thus already contributes to a decoupling of the compressor screw housing and the outer housing in the area of the inlet section.

In conjunction with the inventive solution, it has merely been assumed so far that the space serves to bring about a thermal and vibrational decoupling between the outer housing and the compressor screw housing.

A particularly favorable utilization of the fact that such a space is present is, however, given when the space is acted upon by pressure so that not only is the compressor screw housing acted upon by the pressure resulting internally in the area of the screw rotors during the compression of the working medium but also, on the other hand, a pressure acting from outside on the compressor screw housing counteracts this pressure. It is particularly expedient when the space is subject to a pressure which corresponds approximately to the end pressure of the screw compressor since, in this case, the compressor screw housing is already acted upon from outside by a pressure which always corresponds to the maximum pressure in the interior thereof during the compression of the working medium and so, in the long run, the compressor screw housing is not subject to any one-sided pressure acting on it but, on average, is acted upon with a pressure which is greater than the pressure resulting in the interior thereof.

This solution has the particular advantage that the compressor screw housing need be dimensioned with respect to its mechanical stability only such that it keeps the sealing gap between the screw rotors and the compressor screw housing essentially constant when pressure acts on it from outside and need not be dimensioned, as in the known solutions, such that it is rigid against deformation in relation to a difference in pressure between the interior pressure which ensues and the surrounding pressure.

With respect to the effect of the space, it has so far merely been assumed that the space effects per se a thermal decoupling between the outer housing and the compressor screw housing. It is particularly favorable, however, especially to reduce any thermal distortion between the inlet section and the outlet section or even avoid such distortion which is caused by the inlet section being at the temperature of the working medium entering it whereas the outlet section is heated by the working medium exiting from it and heated due to the compression, when the compressor screw housing can be temperature controlled.

Such a temperature control may preferably be brought about in that the compressor screw housing can be temperature controlled by a temperature control medium provided in the space.

In principle, it would be conceivable to provide any suitable medium as temperature control medium. For example, it would be conceivable to introduce a special temperature control medium into the space for this purpose. The inventive solution is, however, particularly simple when the temperature control medium comprises the working medium.

A supplementary or alternative solution provides for the temperature control medium to comprise oil from a lubricating oil circuit of the screw compressor since this oil from the lubricating oil circuit is likewise heated to a higher temperature, preferably to a temperature close to the temperature of the compressed working medium.

Such a temperature control of the compressor screw housing by a temperature control medium provided in the space can be brought about either by a standing temperature control medium arranged in the space or by the fact that the temperature control medium flows through the space. For example, this may be realized by the fact that with a working medium serving as temperature control medium the compressed working medium flows into the space and as a result leads to the compressor screw housing being heated up.

An alternative solution provides for the oil serving as temperature control medium to form, in the space, an oil bath which can thus likewise serve to control the temperature of the compressor screw housing and keep it at a temperature which is as essentially constant as possible.

In principle, it would be conceivable to design the compressor screw housing as a part which is detachably insertable into the outer housing. A particularly favorable solution does, however, provide for a section of the outer housing and the compressor screw housing to form an integral part so that the compressor screw housing can be fixed relative to the outer housing in a particularly simple manner and, in addition, a particularly precise, immovable arrangement thereof relative to one another results.

In this respect, it is particularly favorable when the compressor screw housing can be machined by fixing it on the outer housing so that the fixing in place of the outer housing does not have any effect on the shape of the compressor screw housing during machining and thus the fixing in place of the outer housing also does not have any disadvantageous effects on the machining of the compressor screw housing.

An additional, advantageous solution provides for the compressor screw housing to be arranged so as to adjoin a first bearing housing for rotary bearings of the screw rotors, wherein the bearing housing is likewise preferably connected in one piece to the outer housing and to the compressor screw housing.

It is, in particular, favorable when the first bearing housing serves to mount the screw rotors at an end thereof on the inlet side.

In addition, it is provided in an advantageous embodiment of the inventive solution for a second bearing housing arranged so as to be located opposite the first bearing housing to adjoin the compressor screw housing, this second bearing housing serving to mount the screw rotors at an end thereof on the outlet side.

In order to provide for a machining of the compressor screw housing in a simple manner, it is favorable when the second bearing housing is detachably connected to the compressor screw housing.

With respect to the assembly and producibility of the compressor screw housing securely connected to a section of the outer housing, it is preferably provided for the compressor screw housing to extend as far as a flange on the outlet side which is located in axial direction approximately in the area of a connecting flange of the section of the outer housing supporting the compressor screw housing so that the interior of the corresponding section of the outer housing is also accessible for machining from the side of the connecting flange and, in particular, the flange of the compressor screw housing on the outlet side, as well, wherein the flange of the compressor screw housing on the outlet side serves to provide a connection to the second bearing housing.

The compressor screw housing has so far been defined only to the extent that it has two rotor bores for the screw rotors of the screw compressor. A particularly preferred variation provides for a regulatable screw compressor so that the compressor screw housing has, in addition, a receiving means for a regulating slide for regulating the performance of the screw compressor.

In conjunction with the preceding explanations concerning the invention, these have merely concentrated on what effect the space has in the sense of a thermal decoupling and, where applicable, also a temperature control of the compressor screw housing.

Alternatively thereto or in addition thereto, one idea representing its own invention provides for an oil separator path to be provided within the outer housing of the screw compressor for the separation of oil out of the working medium exiting from the compressor screw housing on the pressure side.

The advantage of such an oil separator path which is as great as possible creates the possibility of bringing about an optimum separation of oil out of the compressed working medium. In this respect, the oil separator path is preferably designed such that it reaches from one end of the outer housing located opposite an inlet connection of the outer housing as far as an outlet connection for the working medium located in the area of the compressor screw housing so that the oil separator path has as great an extension as possible.

In order to bring about an optimum oil separation, it is preferably provided for a demister to be arranged in the oil separator path for forming oil droplets from an oil mist in the working medium.

In order to bring about an oil separation and a collection of the oil in a suitable manner, it is preferably provided for an oil sump to be formed in the course of the oil separator path.

The oil separator path could be defined within the outer housing by means of special housing elements. However, a particularly favorable solution provides for the outer housing to guide the working medium while it is flowing through the oil separator path and thus create the possibility at the same time of obtaining as long an oil separator path as possible with as large a cross section as possible, namely the maximum cross section possible within the outer housing which results in the flow velocity of the compressed working medium being very slow and thus of an optimum separation of the oil droplets being possible via the oil separator path.

In this respect, it is preferably provided for the working medium to flow around the second bearing housing in the course of the oil separator path and thus already control the temperature of it. A particularly favorable solution which ensures as long an oil separator path as possible provides for the working medium to flow around the compression section of the compression screw housing, i.e. also flow into the space and thus, on the one hand, effect a temperature control of the compressor screw housing and, on the other hand, the possibility is given of designing the oil separator path with as large a volume as possible and as long as possible.

In this respect, it is particularly favorable when the working medium flows as far as the inlet section of the compressor screw housing in the course of the oil separator path so that the maximum possible length of the oil separator path can be achieved and, on the other hand, an optimum temperature control of the compressor screw housing as far as the inlet section.

Additional features and advantages of the invention are the subject matter of the following description as well as the drawings illustrating several embodiments.

Figure 1:
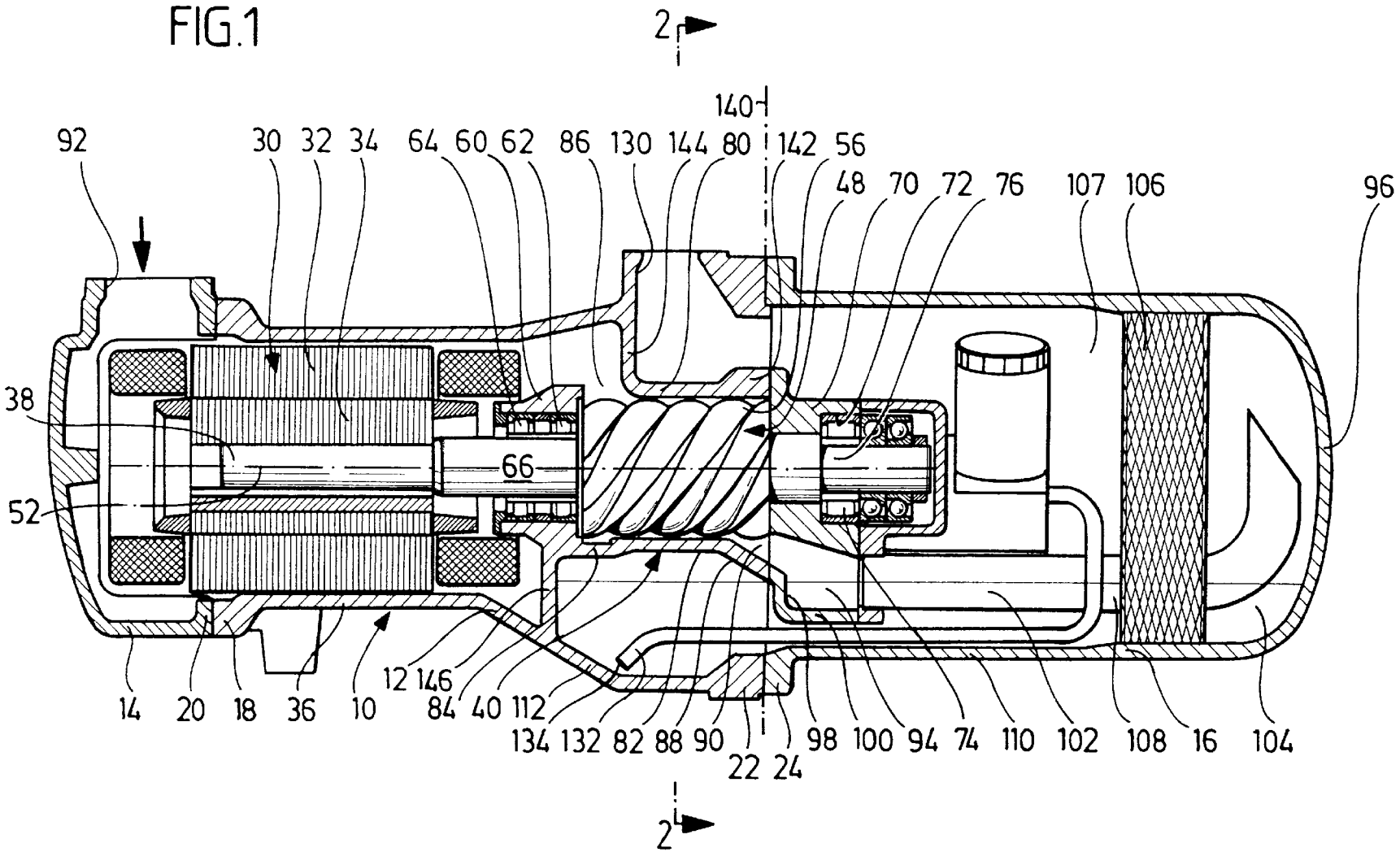
FIG. 1 shows a longitudinal section through a first embodiment of an inventive screw compressor along line 1—1 in FIG. 2.

One embodiment of an inventive screw compressor, illustrated in FIG. 1, comprises an outer housing which is designated as a whole as 10 and is built up of a central section 12, an end section 14 on the motor side and an end section 16 on the pressure side which is arranged on the side of the central section 12 located opposite the end section 14 on the motor side.

The central section 12 and the end section on the motor side are preferably connected to one another by two flanges 18 and 20, respectively, and the central section 12 to the end section 16 on the pressure side by flanges 22 and 24, respectively.

A drive motor designated as a whole as 30 is provided in the outer housing 10, is designed, for example, as an electric motor and comprises a stator 32 as well as a rotor 34. The stator 32 is preferably fixed securely in position in the outer housing 10, in particular, a motor area 36 of the central section 12 facing the end section on the motor side.

Figure 2:
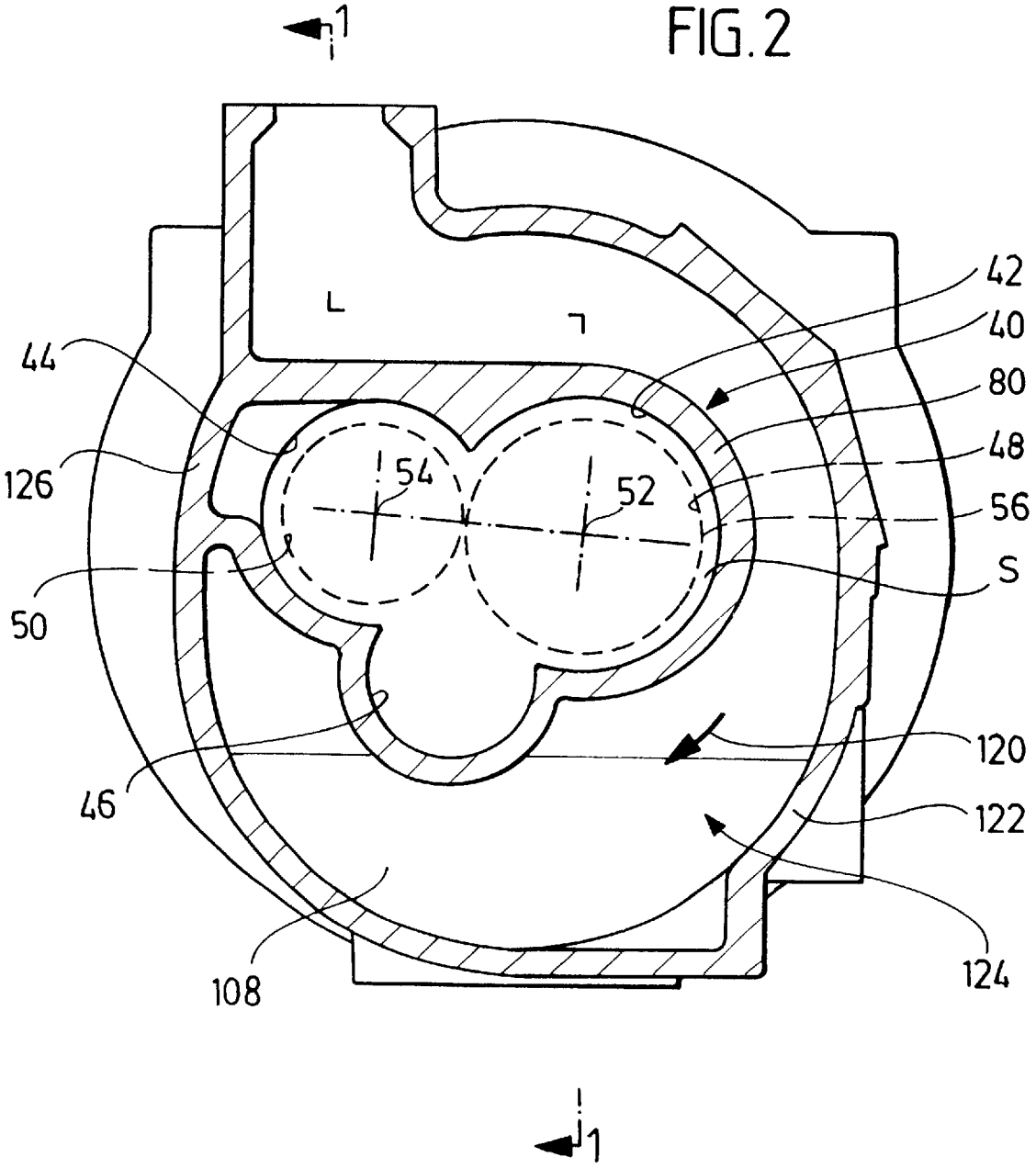
FIG. 2 shows a section along line 2—2 in FIG. 1.

Furthermore, a compressor screw housing designated as a whole as 40 is provided within the central section 12 of the outer housing 10 and, as illustrated in FIG. 2, has two rotor bores 42 and 44 which merge into one another as well as a slide bore 46 for, for example, a regulating slide not apparent in the drawing of FIG. 1.

The rotor bores 42 and 44 serve to accommodate two screw rotors 48 and 50, respectively, which are customary for a screw compressor, wherein the screw rotors 48 and 50 are merely indicated by dashed lines in FIG. 2.

The two screw rotors 48 and 50 rotate about their respective axes of rotation 52 and 54 and are mounted for rotation about their axes of rotation 52 and 54, respectively, on both sides of their respective screw member 56.

For this purpose, a bearing housing 60, which has first bearing receiving means 62 for first rotary bearings 64 of the two screw rotors 48, 50, adjoins the compressor screw housing on a side facing the drive motor 30, wherein the screw rotors 48, 50 have shaft sections 66 which proceed from the screw members 56 and on which the rotary bearings 64 are seated. One of these shaft sections 66 is arranged coaxially to a drive shaft 38 of the drive motor 30 and is connected to it.

Furthermore, on their side located opposite the bearing housing 60 the screw rotors 48, 50 are rotatably mounted in a second bearing housing 70 with second bearing receiving means 72 likewise by means of second rotary bearings 74, wherein the screw rotors likewise have for this purpose shaft sections 76 projecting from the screw members 56.

The compressor screw housing 40 thus extends between the first bearing housing 60 and the second bearing housing 70 over the entire length of the screw members 56 in the direction of their rotor axes 52 and 54, respectively, and encloses the screw rotors 48 and 50 in the area of their screw members 56 so that a sealing gap S remains between the screw member 56 and the rotor bores 42 and 44 which is of as small a design as possible for sealing.

All the areas of the compressor screw housing 40, in which a wall 80 of the compressor screw housing 40 extends relative to the screw members 56 whilst forming the gap S, form a compression section 82 of the compressor screw housing 40 which is adjoined on the inlet side, namely on a side facing the drive motor 30, by an inlet section 84 which forms an inlet 86 for medium to be compressed and on the outlet side, namely on a side located essentially diagonally opposite the inlet 86, by an outlet section 88 which forms an outlet 90, from which the compressed working medium exits.

During a normal mode of operation of the inventive screw compressor according to FIGS. 1 and 2 the working medium to be compressed flows in through an inlet connection 92 which is provided in the end section of the outer housing 10 on the motor side. The working medium flowing into the end section 14 of the outer housing on the motor side then flows through the drive motor 38 and flows as far as the inlet 86 of the compressor screw housing 40, wherein the working medium passes through the drive motor 38 parallel to the direction of the axes of rotation 52 and 54 and is hereby guided, on the one hand, by the end section 14 of the outer housing on the motor side and by the motor area 36 of the central section 12 of the outer housing 10. The working medium to be compressed is also guided through the outer housing 10 to the inlet 86 of the compressor screw housing 40 once it has passed through the drive motor 38.

After entering the compressor screw housing 40, the working medium is subjected to compression by means of the screw rotors 48 and 50 and so the compressed working medium exits at the outlet 90 of the compressor screw housing and thereby enters a guide channel 94 which guides the compressed working medium into an area close to a cover 96 on the end side of the end section 16 on the pressure side.

The guide channel 94 is formed, on the one hand, by a receiving chamber 98 which is arranged in continuation of the outlet section 80 of the compressor screw housing 40 and is enclosed by a chamber housing 100 integrally formed on the second bearing housing 70 and by a guide tube 102 which adjoins the receiving chamber 98 and guides the compressed working medium into a distribution chamber 104 which is arranged in the end section 16 on the pressure side close to the cover 96 and is enclosed by the end section 16 on the pressure side, in particular, the cover 96. In this distribution chamber it is possible for the compressed working medium to be spread over a flow cross section which is approximately in the order of magnitude of an inner cross section of the end section 16 on the pressure side. With this flow cross section the compressed working medium can flow through a demister 106 which is at a distance from the cover 96 and covers the entire cross section of the end section 16 of the outer housing 10 on the pressure side and which adjoins the distribution chamber 104 on the side located opposite the cover 96.

The demister 106 has the task of combining oil mist carried along in the compressed working medium to form drops and thus of contributing to the separation of oil out of the compressed working medium. Drops of oil are therefore already formed in the course of flowing through the demister 106 and these drops of oil either settle already in the demister 106 in the direction of gravity and contribute to forming an oil sump 108 in an area 110 on the base side of the end section 16 on the pressure side as well as an area 112 of the central section 12 on the base side.

The compressed working medium flows from the demister 106 further in the direction of the second bearing housing 70 and the compressor screw housing 40 through an inner chamber 107 of the end section 16, with further separation of drops of oil into the oil sump 108, with a flow cross section which is likewise in the order of magnitude of the inner cross section of the end section 16 and which, in comparison with the guide tube 102, likewise causes a reduction in the flow velocity of the working medium and thus an improved separation of the oil.

As a result of the fact that the compressor screw housing 40, as illustrated in FIG. 2, extends with its walls 80 in azimuthal direction 120 in relation to the axes of rotation 52 and 54 at a distance from walls 122 of the central section 12 of the outer housing in the area of the compressor screw housing 40, a space 124 is formed between the compressor screw housing 40 and the central section 12 of the outer housing 40 and this space surrounds the compressor screw housing 40 essentially in the azimuthal direction 120, extends essentially around the outlet section 88 as well as the compression section 82 proceeding from the second bearing housing 70 and also reaches the inlet section 84. The space 124 thereby extends over at least three quarters of the circumference of the compressor screw housing 40 in azimuthal direction and is interrupted in the azimuthal direction 120 only by a narrow wall section 126, in which the wall 80 of the compressor screw housing 40 merges into the wall 122 of the central section 12 of the outer housing 10.

In accordance with the invention, an outlet connection 130 is arranged in the area of the space 124, preferably at the level of a transition from the inlet section 84 to the compression section 82 of the compressor screw housing 40 and this outlet connection is located opposite the area 112 of the central section 12 on the base side so that the compressed working medium can flow away out the space 124 through the outlet connection 130, wherein a check valve which is not illustrated in the drawing of FIG. 1 is preferably associated with the outlet connection 130.

Proceeding from the distribution chamber 104, as already described, the compressed working medium thus flows first of all around the demister 106 and then flows in a direction parallel to the axes of rotation 52, 54 first of all through the inner chamber 107 of the end section 16 on the pressure side and then into the space 124 between the central section 12 and the compressor screw housing 40 and then through the outlet connection 130 out of the outer housing 10.

In addition, the oil sump 108 formed close to the base-side areas 110 and 112 of the end section 16 on the pressure side and the central section 12, respectively, also extends into the space 124 and forms an oil bath on the base side thereof, wherein oil is drawn off for the lubrication of the screw rotors 48, 50 and the rotary bearings 64, 74 with a suction tube 132, the opening 134 of which is located in the area of a lowest point of the space 124, preferably on a side thereof facing the drive motor 30.

Depending on the level of oil in the oil bath 108, this is in contact with the walls of the compressor screw housing 40 or below them.

Altogether, the compressor screw housing 40, in particular with the walls 80 of the compression section 82, is thus acted upon with working medium subject to end pressure through the space 124 essentially surrounding it from its outer side located opposite the screw members 56, wherein the end pressure corresponds to the maximum pressure which can occur within the compressor screw housing 40 in the area of the screw members 56 so that, as a result, a variation in the pressure gap S dependent on pressure, which occurs in all the screw compressors, with which the compressor screw housing is subject on its outer side to ambient pressure, i.e. not to a pressure corresponding to the end pressure of the working medium, due to expansion of the walls 80 of the compressor screw housing 40, is avoided.

In addition, the fact that the working medium entering the space 124 flows around the compressor screw housing 40 serves to heat up the walls 80 of the compressor screw housing 40 to a temperature which corresponds to the temperature of the working medium exiting from the outlet 90 on the pressure side so that, as a result, a thermal distortion of the compressor screw housing 40 on account of the difference in temperature between the working medium entering at the inlet 86 and working medium exiting from the outlet 90 is avoided since the working medium flowing into the space 124 leads to an even heating up and thus to an even temperature control of the compressor screw housing from the outlet section 80 via the compression section 82 as far as the inlet section 84.

If the oil sump 108 reaches a level which is so high that contact occurs between the compressor screw housing 40 and the oil sump, the oil sump likewise serves for the temperature control of the compressor screw housing since all the oil separated out of the compressed working medium likewise has the temperature of the working medium exiting from the outlet 90 on the pressure side.

In addition, the inventive solution creates the possibility of making a constructionally long oil separator path available for the separation of the oil out of the compressed working medium and this path extends from the cover 96 of the end section 16 on the pressure side through the distribution chamber 104, the demister 106 and the inner chamber 107, which has the working medium flowing around it, of the end section 16 on the pressure side in the area of the second bearing housing 70 as far as the space 124 and thus ensures a good separation of oil.

In addition, as a result of oil being drawn off via the opening 134 of the suction tube 132 in the area of the space 124, preferably in an area facing the drive motor 30, the possibility is created of making a long path available for the oil in the oil sump 108 between the demister 106 and the opening 134 and in this path the oil has the chance to degas, i.e. the working medium still dissolved in the oil can exit from the oil and so oil degassed to a sufficient extent is available at the opening 134 for drawing off for the oil supply.

The central section 12 of the outer housing 10 is advantageously designed such that its flange 22, which represents a connection flange for the connection of the end section 16 on the pressure side with its flange 24, is located in a plane 140 which also coincides approximately with an end flange 142 of the compressor screw housing, on which the second bearing housing 70 can be flanged-mounted with the chamber housing 100.

As for the rest, the compressor screw housing 40 is, as illustrated in FIG. 1, designed as a part which can be produced in one piece with the central section 12, wherein a connection between the compressor screw housing 40 and the central section 12 of the outer housing 10 is brought about, on the one hand, by the wall area 126 and, on the other hand, is brought about by the bearing housing 60 which is likewise integrally formed in one piece on the compressor screw housing 40 and likewise integrally formed in one piece on the central section 12 of the outer housing 10. An additional connection between the compressor screw housing 40 and the central section 12 of the outer housing 10 is, furthermore, brought about by a wall section 144 of the inlet section 84 which is conducted in the area of the inlet 86 as far as the outlet connection 130 integrally formed in one piece on the central section 12 of the outer housing 10.

Furthermore, the first bearing housing 60 is preferably supported by a dividing wall 146 which separates the space 124 from the motor area 36 of the central section 12 and thus guides the working medium flowing through the motor area 36 of the central section 12 and serving to cool the drive motor 30 to the inlet 86 of the inlet section 84 of the compressor screw housing 40.

The central section 12 thus forms with the compressor screw housing 40, the wall 144 and the dividing wall 146 an integral part which is designed such that it, on the one hand, guides the incoming working medium flowing through the drive motor 30 automatically to the inlet 86 of the inlet section 84 and, on the other hand, allows the compressed working medium flowing back from the end section 16 on the pressure side to first enter the space 124 but then guides it from the space 124 to the outlet connection 130 and thus separates the working medium flowing in on the inlet side from the working medium flowing away on the pressure side at the same time.

In a second embodiment, illustrated in FIGS. 3 to 6, those parts which are identical to those of the first embodiment are given the same reference numerals.

Figure 3:
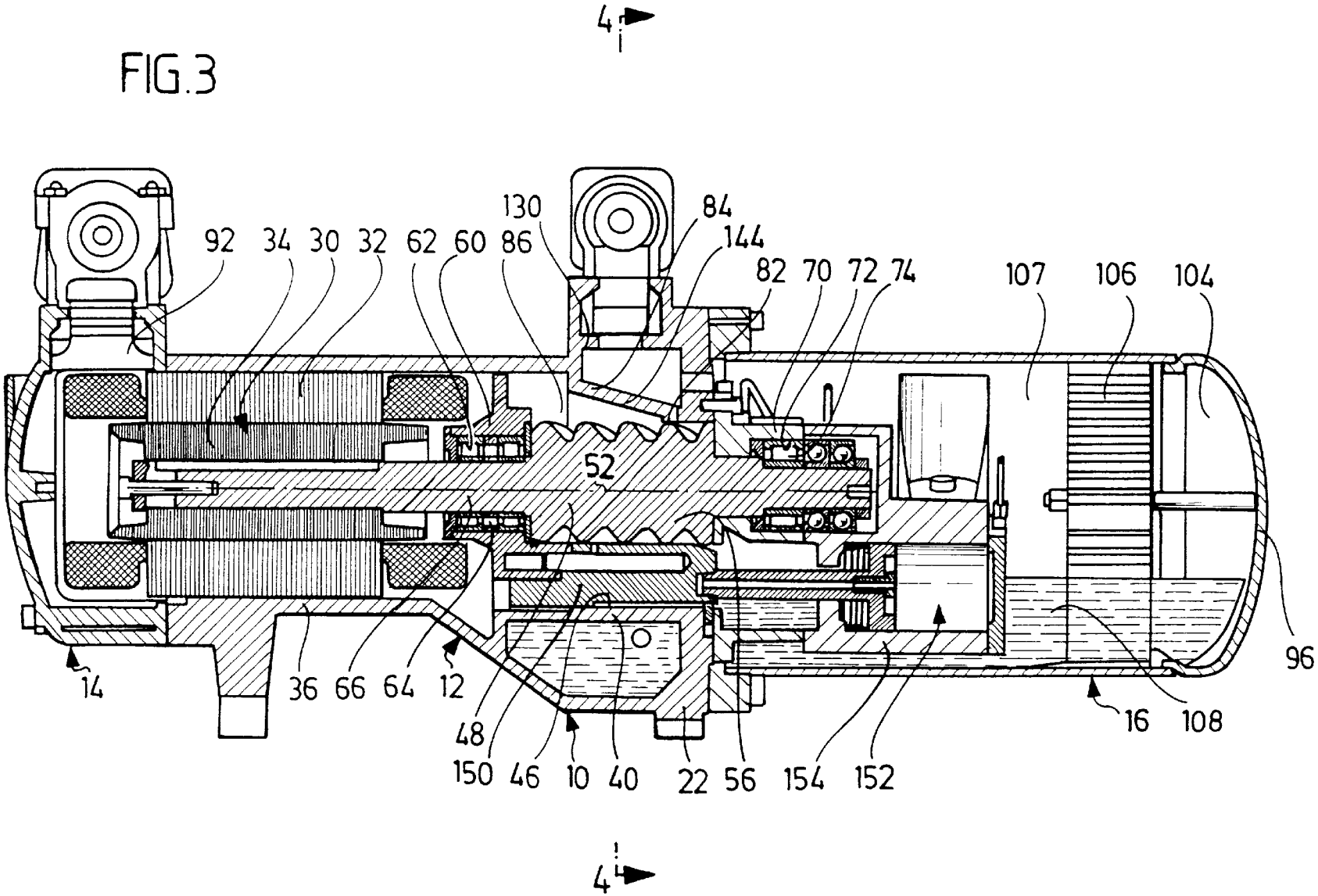
FIG. 3 shows a longitudinal section similar to FIG. 1 through a second embodiment of an inventive compressor along line 3—3 in FIG. 4.

In contrast to the first embodiment, a regulating slide 150 is illustrated in addition in the section illustrated in FIG. 3 and this slide is arranged in the slide bore 46. Furthermore, a control cylinder 152 required for actuating the regulating slide 150 is also apparent and this cylinder is arranged in a control cylinder housing 154 which is securely connected to the second bearing housing 70. The control of the control cylinder 152 is brought about in the manner known thus far with oil pressure or gas pressure, as a result of which a displacement of the regulating slide 150 parallel to the axes of rotation 52, 54 takes place in order to control the capacity of the compressor in a known manner.

In addition, the inlet section 84 of the compressor screw housing is designed on an enlarged scale in the second embodiment of the inventive screw compressor, in particular, in that the wall 144 extends at an angle from the outlet connection 130 as far as the compression section 82 in the direction of the axes of rotation 52, 54 so that an appreciable portion of the screw member 56 serves to draw in working medium through the inlet 86 on its side facing the inlet area 84.

Figure 4:
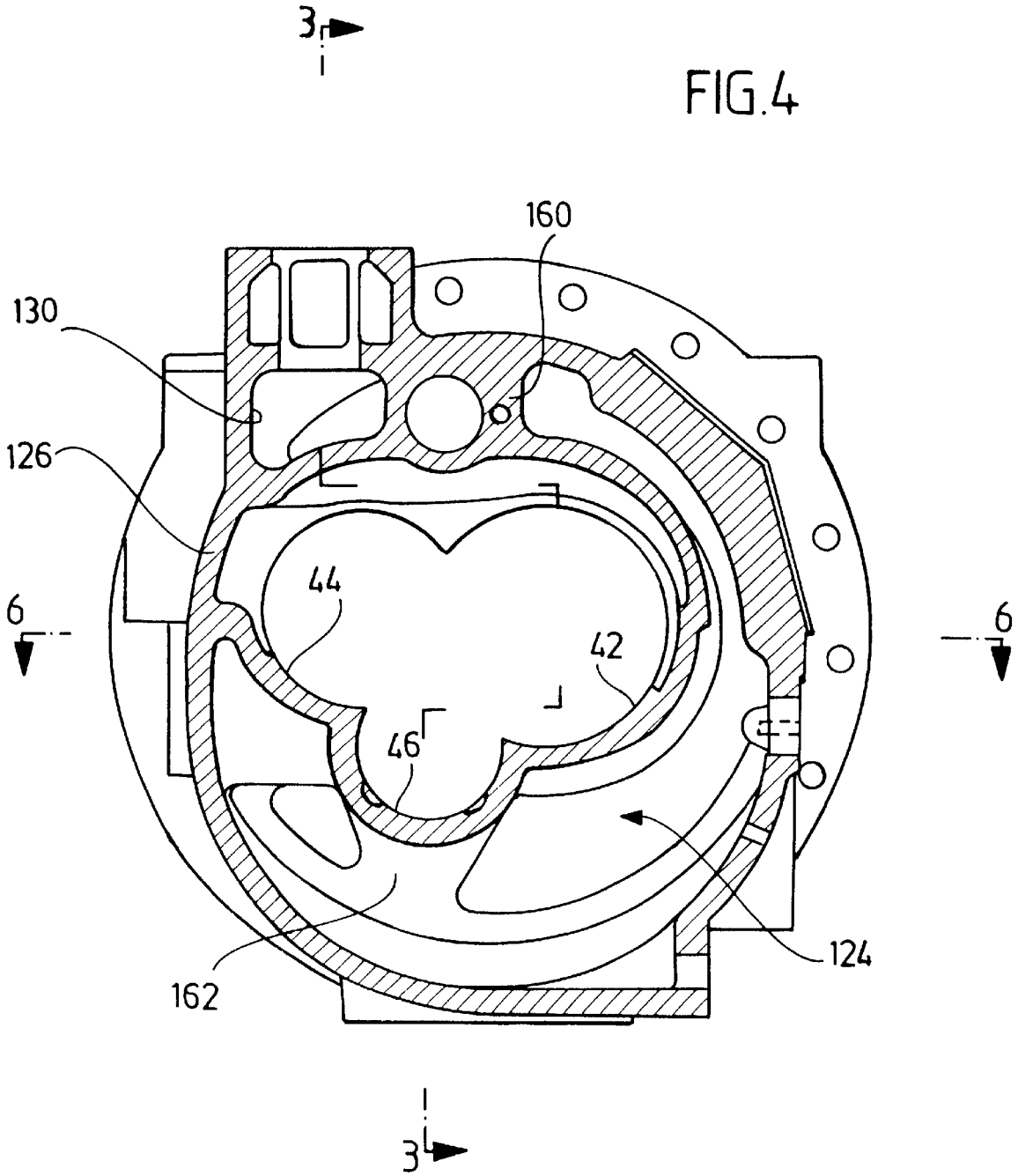
FIG. 4 shows a cross section along line 4—4 in FIG. 3.
Figure 5:
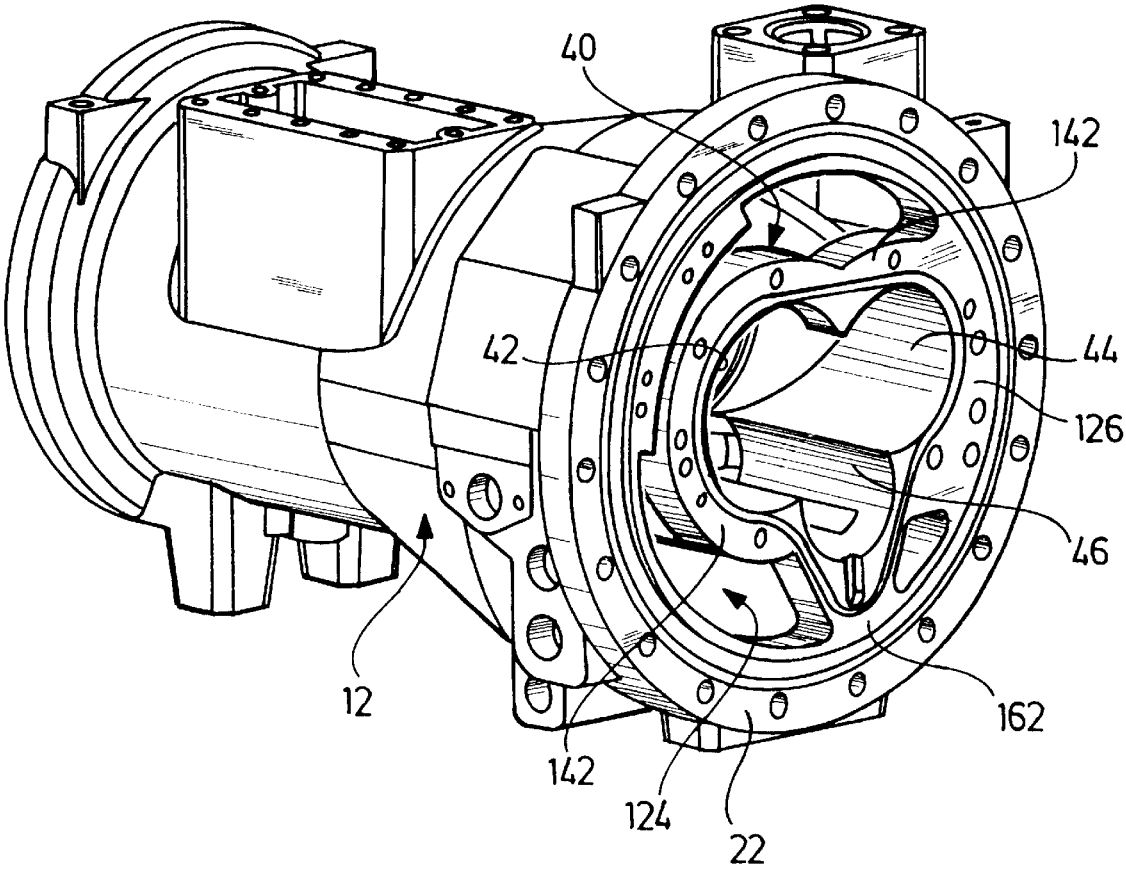
FIG. 5 shows a perspective view of a central section of the outer housing with a compressor screw section arranged therein.
Figure 6:
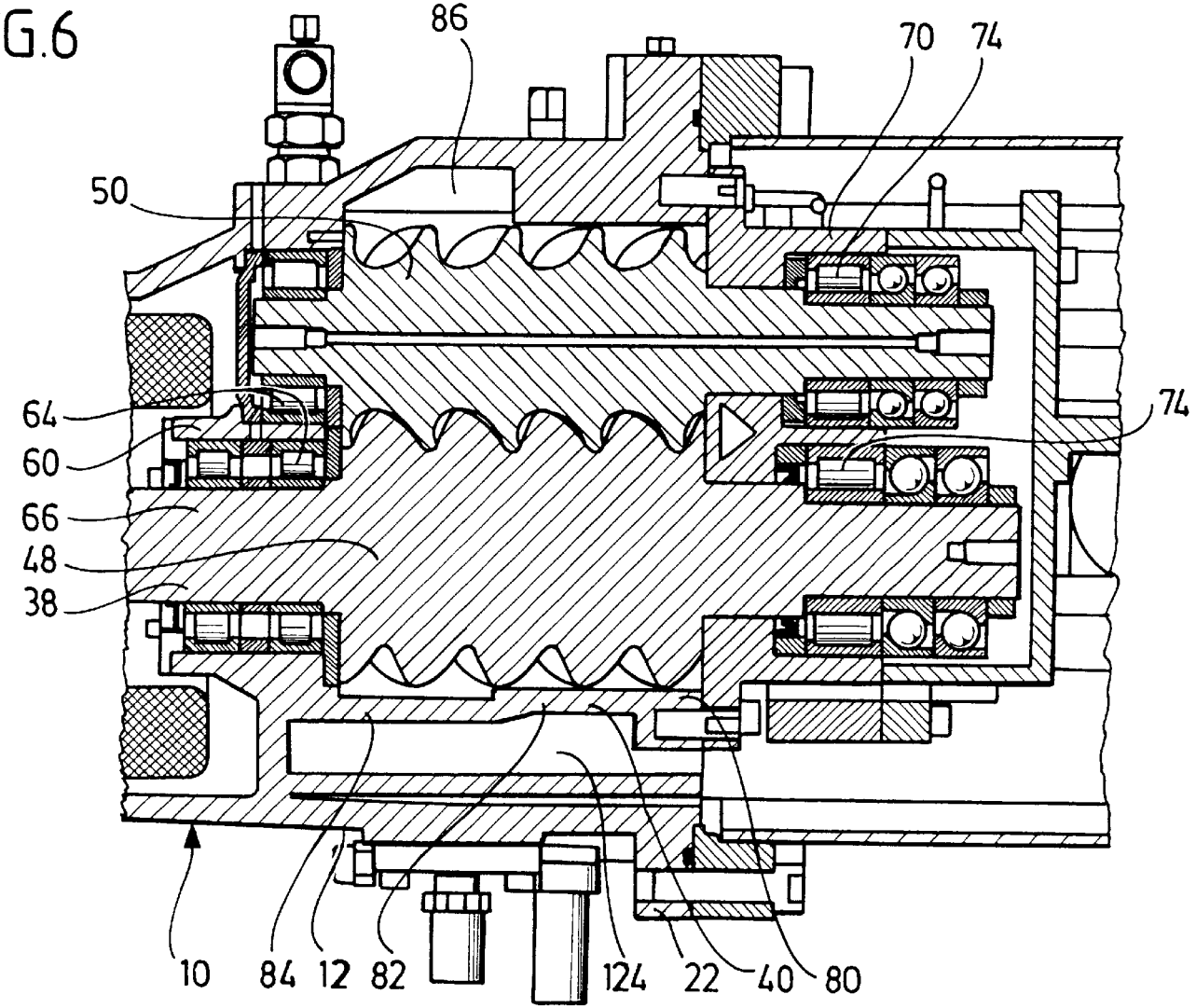
FIG. 6 shows a section along line 6—6 in FIG. 4.

In addition, as illustrated in FIG. 4, the space 124 is penetrated by additional reinforcing webs 160 and 162 which contribute to a rigid fixing of the compressor screw housing 40 within the central section 12 of the outer housing 10.

With respect to the additional features, the second embodiment is of the same design as the first embodiment and so the same elements have the same reference numerals and reference is made to the first embodiment with respect to their description.

As for the rest, the second embodiment operates in the same way as the first embodiment and so with respect to its operation and the advantages reference is made in full to the comments on the first embodiment.

What is claimed is:

1. A screw compressor for compressing a working medium, comprising:

an outer housing;

a compressor screw housing provided within the outer housing;

a second bearing housing arranged on an outlet side of said compressor screw housing and within said outer housing;

two screw rotors arranged in rotor bores provided in said compressor screw housing;

a drive for the screw rotors;

a space arranged between a substantial part of the compressor screw housing and the outer housing, said space extending on average over at least half of a length of the compressor screw housing in an axial direction of the screw rotors; and an outlet connection through said outer housing arranged in the area of said space such that said compressor screw housing and said second bearing housing are temperature controlled by compressed working medium flowing alongside said second bearing housing into said space and through said space and said outlet connection out of the outer housing.

2. A screw compressor as defined in claim 1, wherein said space is subject to a pressure corresponding approximately to the end pressure of the screw compressor.

3. A screw compressor as defined in claim 1, wherein said outlet connection is arranged in the area of said space at a level of a transition from said inlet section to said compression section of said compressor screw housing.

4. A screw compressor as defined in claim 1, wherein said outlet connection is located opposite an area of a central section of said outer housing receiving an oil sump.

5. A screw compressor as defined in claim 1, wherein compressed working medium flows from an inner chamber in an end section of said outer housing into said space.

6. A screw compressor as defined in claim 1, wherein a section of the outer housing and the compressor screw housing form an integral part.

7. A screw compressor as defined in claim 1, wherein the compressor screw housing extends as far as a flange on the outlet side located in an axial direction approximately in the area of a connecting flange of the section of the outer housing supporting the compressor screw housing.

8. A screw compressor as defined in claim 1, wherein the compressor screw housing has a receiving means for a regulating slide.

9. A screw compressor as defined in claim 1, wherein the compressor screw housing has an inlet section, a compression section and an outlet section.

10. A screw compressor as defined in claim 9, wherein said space extends in azimuthal direction to the rotor bores over at least half the circumference of the compression section.

11. A screw compressor as defined in claim 9, wherein said space extends over at least approximately three quarters of the circumference of the compression section.

12. A screw compressor as defined in claim 9, wherein said space extends in azimuthal direction to the rotor bores over at least half the inlet section.

13. A screw compressor as defined in claim 12, wherein said space extends over three quarters of the circumference of the inlet section.

14. A screw compressor as defined in claim 9, wherein said space extends from an end of the compressor screw housing on the outlet side in the direction of an end of said compressor screw housing on the inlet side.

15. A screw compressor as defined in claim 14, wherein said space extends at least over the compression section.

16. A screw compressor as defined in claim 15, wherein said space extends as far as the inlet section.

17. A screw compressor as defined in claim 1, wherein the compressor screw housing is further temperature controlled by oil from a lubricating oil circuit of the screw compressor.

18. A screw compressor as defined in claim 17, wherein the oil serving as a temperature control medium forms an oil bath in said space.

19. A screw compressor as defined in claim 1, wherein the compressor screw housing is arranged so as to adjoin a first bearing housing for rotary bearings of the screw rotors.

20. A screw compressor as defined in claim 19, wherein a first bearing housing serves to mount first rotary bearings for the screw rotors at an inlet side thereof.

21. A screw compressor as defined in claim 1, wherein the second bearing housing is arranged so as to be located opposite a first bearing housing and adjoins the compressor screw housing.

22. A screw compressor as defined in claim 21, wherein the second bearing housing is detachably connected to the compressor screw housing.

23. A screw compressor as defined in claim 22, wherein the second bearing housing serves to mount second rotary bearings for the screw rotors at an outlet side thereof.

24. A screw compressor for compressing a working medium, comprising:

an outer housing;

a compressor screw housing provided within the outer housing;

a second bearing housing arranged on an outlet side of said compressor screw housing and within said outer housing;

two screw rotors arranged in rotor bores provided in said compressor screw housing;

a drive for the screw rotors;

a space arranged between a substantial part of the compressor screw housing and the outer housing; and an oil separator path provided within the outer housing of the screw compressor for the separation of oil out of the working medium exiting from the compressor screw housing on the pressure side, said oil separator path reaching from one end of said outer housing located opposite an inlet connection of the outer housing alongside said second bearing housing into said space as far as an outlet connection for the working medium located through said outer housing in the area of said space.

25. A screw compressor as defined in claim 24, wherein a demister for forming oil droplets from an oil mist in the working medium is arranged in the oil separator path between said one end of said outer housing and said second bearing housing.

26. A screw compressor as defined in claim 24, wherein an oil sump is formed in the course of the oil separator path.

27. A screw compressor as defined in claim 24, wherein the outer housing guides the working medium while it is flowing through the oil separator path.

28. A screw compressor as defined in claim 24, wherein the working medium flows around a second bearing housing in the course of the oil separator path.

29. A screw compressor as defined in claim 24, wherein the working medium flows around a compression section of the compressor screw housing.

30. A screw compressor as defined in claim 24, wherein the working medium flows in a direction towards an inlet section of the compressor screw housing in the course of the oil separator path.

* * * * *